United States Patent [19]

Pinomäki

[11] 4,350,055

[45] Sep. 21, 1982

[54] LEVER OPERATED CONTROL APPARATUS

[76] Inventor: Sakari Pinomäki, SF-39160 Julkujarvi, Finland

[21] Appl. No.: 152,466

[22] Filed: May 23, 1980

[30] Foreign Application Priority Data

May 29, 1979 [FI] Finland ..... 791713

[51] Int. Cl.[3] ..... G05G 9/02

[52] U.S. Cl. ..... 74/471 XY; 74/470; 200/6 A; 267/150; 267/155

[58] Field of Search ..... 74/471 XY, 470; 200/6 A; 267/150, 155

[56] References Cited

U.S. PATENT DOCUMENTS

| | | | |
|---|---|---|---|
| 3,299,731 | 1/1967 | Russell, Jr. | 200/6 A X |
| 3,306,125 | 2/1967 | Purcell et al. | 74/471 XY |
| 3,550,466 | 12/1970 | Ham | 200/6 A X |

*Primary Examiner*—Allan D. Herrmann

*Attorney, Agent, or Firm*—Pollock, Vande Sande & Priddy

[57] ABSTRACT

A lever operated control for two transverse shafts connected for rotating drive control devices. The lever rotates in a first plane normal to a shaft and in second plane in the direction of the shaft. Two spring elements connect the shafts and lever maintaining the lever in a neutral position until operated.

3 Claims, 1 Drawing Figure

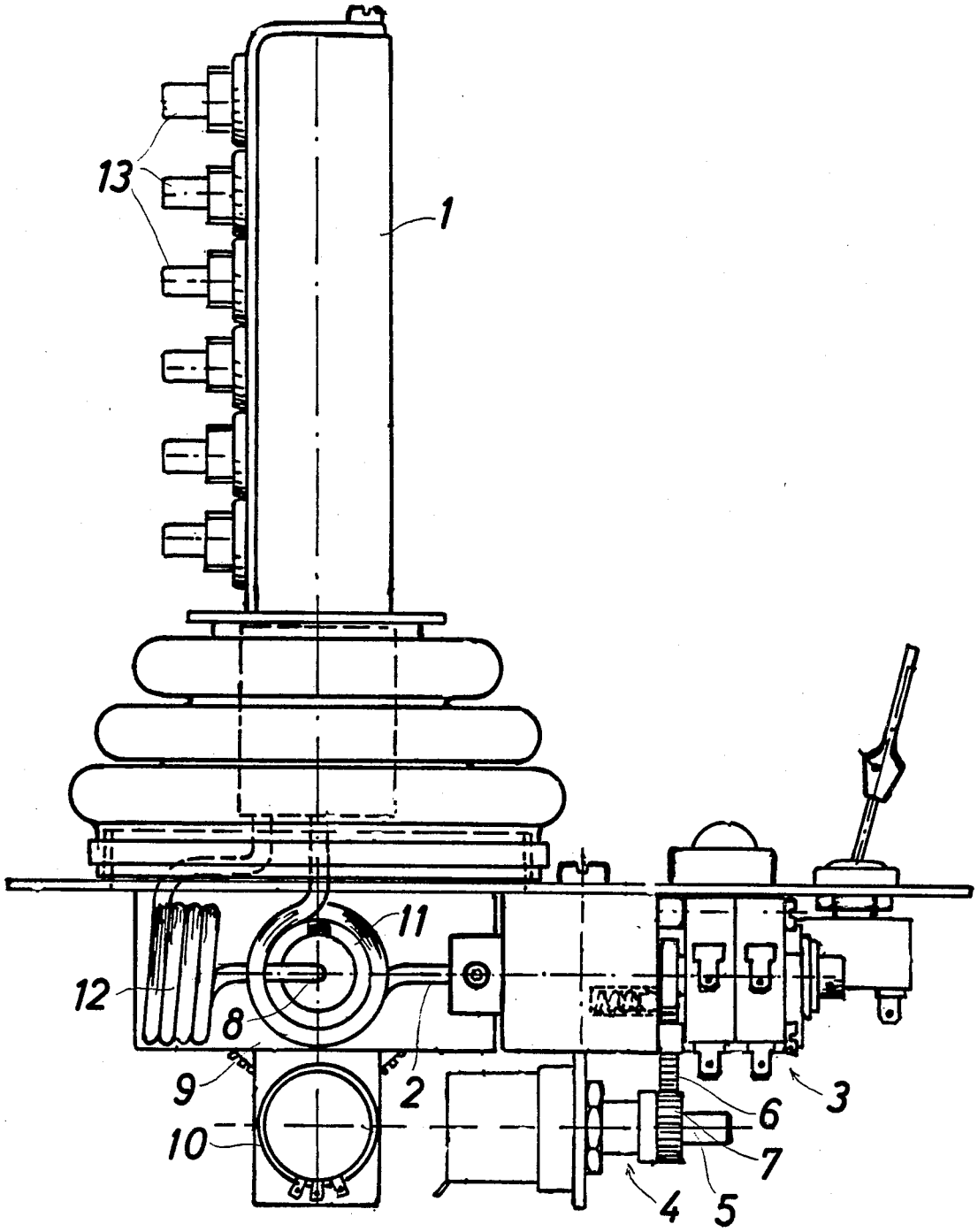
13
1
11
12
8
9
2
10
6
3
7
4
5

LEVER OPERATED CONTROL APPARATUS

The invention relates to regulating levers or the like which is designed to be turned relative to two shafts transverse to one another, for controlling hydraulic means in various machines and equipment.

Such regulating lever structures are commonly used in connection with the manual operation of hydraulic machines. The lever is fitted to incline or to rotate in relation to two shafts which, for the greatest advantage, are perpendicular to one another. The turning relative to one shaft allows regulation of a potentiometer which in turn controls a magnetic valve or a servo valve, which aids in furthr controlling the function of a work cylinder or a hydraulic motor to produce a certain action by a machine. Rotation of the lever relative to the shaft perpendicular to the remaining shaft will, on the other hand, regulate another potentiometer to control another respective hydraulic action. In the known structures of this type the lever is connected to the aforesaid shafts by a universal joint. Further, both shafts have springs keeping the lever centered or in neutral position thus enabling the deflection of the lever in different directions with regard to each shaft to yield divergent actions, respectively, to control the machine.

The drawback of the known regulating levers of this type is the relatively complicated structure which requires both the universal joint and the centering springs. This again makes the structure expensive to manufacture and to service.

The purpose of this invention is to produce a new regulating lever structure of the aforesaid type without having these drawbacks.

With the aid of the structure according to the invention, the coupling between the movement of the lever and the controlled equipment becomes very simple relative to the previously known ones; thus, the cost of manufacturing is reduced, it becomes easy to service and is reliable.

The invention is described in more detail in the following description which presents one of the forms of performance of the invention, referring simultaneously to the enclosed drawing which shows the structure of the regulating lever from a lateral view.

The lever structure invented and illustrated in the Figure comprises a manually operated regulating lever (1) which can be turned relative to two perpendicular shafts. The shafts rotate and simultaneously move the control device attached to the shafts. In the example shown in the figure the horizontal shaft (2) in the plane of the drawing rotates the control devices (3) and (4). The device (4) is on shaft (5) which is connected to shaft (2) by gear wheels (6) and (7). The control devices can be for example potentiometers or the like controlling a magnetic valve or other device for instance to drive a hydraulic engine. Then, turning the lever to either side of the center position in order to rotate the shaft (2) attached to it moves the machine forward or backward, depending on the direction of rotation. In addition to the aforementioned rotating shaft (2) another rotating shaft (8) has been arranged; it is perpendicular to the plane of the drawing and rotates similar control devices (9) and (10) as shaft (2).

In this invention the new and different thing is that the lever (1) is attached to the rotating shaft (2) with a coil spring (11) which transmits the torque to the shaft (2) but allows simultaneous turning of the lever (1) in the longitudinal plane of shaft (2) because the spring (11) gives. This turning of the lever (1) in the longitudinal plane of the shaft (2) effects rotation of the other rotating shaft (8) through the other spring (12) attached to the end of the lever (1) and to the shaft (8). Also, both springs keep the lever centered, in its neutral position the spring (11) centering the lever in the plane in the direction of the shaft (2) and the spring (12) centering the lever in the plane in the direction of the shaft (8).

In other words, the invented apparatus provides the advantage that the transmission mechanism coupling the movement of the lever to both driving shafts is very simple. No universal joints or separate centering springs are needed for the transmission of movement or centering of the lever. The same elements, in this case transverse coil springs, transmit the movement of the lever and simultaneously center the lever while in the resting position. Thus, the structure is very simple. The springs can be easily changed. There are no lubrication problems. There is no allowance for friction in the transmission.

The transmission springs are most advantageously formed as coil springs, but apparently other types of springs could also be used. The springs have been placed in such a position that the spring effect directing the centering movement of the lever takes place in both directions in the plane normal to the spring shaft.

Further, several push button controls (13) have been installed in the arm of the lever allowing control of several pairs of work cylinders with the same lever. The desired cylinder pair is chosen for driving with a push button control according to the action needed. The selecting switch is not, however, necessary to this invention.

The apparatus described according to the invention may vary from the foregoing but still remains within the claims which follow.

I claim:

1. A lever-operated control apparatus comprising:
   - two shafts, said shafts supported transverse to each other, the shafts connected to drive control devices,
   - a lever supported to rotate in a first plane normal to one shaft and in a plane in the direction of the one shaft; and
   - two spring elements connecting the lever and the shafts, said spring elements being the only members coupling control movement from the lever to the shafts, said spring elements maintaining the lever in a neutral position when said lever is not being rotated.

2. A lever-operated control apparatus as claimed in claim 1 wherein said spring elements comprise coil springs by which the lever is connected to each shaft so that the springs, each in the plane in the direction of a connected shaft center the lever.

3. A lever-operated control apparatus as claimed in claim 1, wherein the coil springs have longitudinal axes at least proximately intersect an extension of the connected shaft of the other spring.

* * * * *